US009272538B2

(12) United States Patent
Livingston

(10) Patent No.: US 9,272,538 B2
(45) Date of Patent: Mar. 1, 2016

(54) DIGITAL PRINTER PLATEN MATERIAL HOLDING APPARATUS

(71) Applicant: Darren Livingston, Denver, CO (US)

(72) Inventor: Darren Livingston, Denver, CO (US)

( * ) Notice: Subject to any disclaimer, the term of this patent is extended or adjusted under 35 U.S.C. 154(b) by 0 days.

(21) Appl. No.: 14/036,237

(22) Filed: Sep. 25, 2013

(65) Prior Publication Data

US 2015/0151551 A1 Jun. 4, 2015

Related U.S. Application Data

(60) Provisional application No. 61/710,579, filed on Oct. 5, 2012.

(51) Int. Cl.

| | |
|---|---|
| ***B41J 2/00*** | (2006.01) |
| ***B41J 3/407*** | (2006.01) |
| ***B41J 11/06*** | (2006.01) |
| *B41J 13/24* | (2006.01) |

(52) U.S. Cl.

CPC ..... *B41J 3/4078* (2013.01); *B41J 11/06* (2013.01)

(58) Field of Classification Search

CPC ..... B41J 11/02; B41F 15/00; B41F 17/003; B41F 17/005; B41F 17/38; B41F 15/18; B41F 15/20; B41F 15/26; B41F 1/36; B41F 21/005; B41F 21/04–21/06; B41F 21/12; B41F 21/14

USPC ..... 347/110; 400/622

See application file for complete search history.

(56) References Cited

U.S. PATENT DOCUMENTS

| | | | | |
|---|---|---|---|---|
| 5,673,621 | A * | 10/1997 | Vaughan | 101/126 |
| 6,631,985 | B2 * | 10/2003 | Koizumi et al. | 347/101 |
| 6,883,911 | B2 * | 4/2005 | Niimi et al. | 347/104 |
| 7,040,748 | B2 * | 5/2006 | Niimi et al. | 347/104 |
| 7,222,445 | B2 * | 5/2007 | Schmidt | 38/102.91 |
| 7,458,174 | B1 * | 12/2008 | Gustin et al. | 38/102.2 |
| 7,681,510 | B2 * | 3/2010 | Watanabe | D05B 39/00 112/103 |
| 7,854,200 | B2 * | 12/2010 | Livingston | 101/474 |
| 2007/0103529 | A1 * | 5/2007 | Pearl et al. | 347/101 |
| 2013/0340640 | A1 * | 12/2013 | Yanagishita | 101/474 |

* cited by examiner

*Primary Examiner* — Jannelle M Lebron
*Assistant Examiner* — Jeremy Bishop
(74) *Attorney, Agent, or Firm* — Trenner Law Firm, LLC; Mark D. Trenner

(57) ABSTRACT

The present invention relates improved device is provided for holding down textile the material on the platen of the digital printer. The inventive device includes a textile gripping material formed to define a border band on the periphery of the platen. The border material has a structure that engages/grips the textile and hold the textile in place. In operation, the textile is laid onto the platen surface and the edges are pulled taut to align the textile and remove wrinkles and the textile is next pressed onto the border material to be engaged by the border material. The border material grips and holds the textile in position, to provide a smooth textile surface on which the ink jets are applied. After the printing operation, the textile is lifted off of the border material and removed from the platen.

10 Claims, 4 Drawing Sheets

DIGITAL PRINTER PLATEN MATERIAL HOLDING APPARATUS

BACKGROUND OF INVENTION

The present invention claims the benefit of the filing date of the provisional application filed on 9 Oct. 2012 by the same inventor hereof, Darren Livingston, for "Digital Printer Platen Material Holding Apparatus" and is an improvement in the field of U.S. Pat. No. 7,854,200.

The invention relates generally to digital printing machines wherein, as is known, the printer prints on textiles directly. Digital printing is a much newer process than the long established screen printing technique, although the latter technique is still in wide use. The digital printing method makes possible the reproduction of complicated design, to print colors and detail that were not feasible before, to readily make changes in design etc.

Digital printers can effectively print on different type materials and on material of different sizes and on material placed or positioned on a relatively large platen. It has been found that the materials positioned on the platen must be wrinkle free, and be stretched tautly and smoothly over the platen to provide satisfactory printing results. Since the platens and the material positioned thereon are both relatively of large size, better means have been sought for positioning/mounting the material on the platen in a smooth, wrinkle free and firmly taut fashion.

SUMMARY OF INVENTION

The present invention relates to a digital printer for textile material wherein an improved device is provided for holding down the material on the platen of the digital printer. The material is held down in a smooth, firm and wrinkle free position for purposes of suitably printing images and/or text thereon. More specifically, the inventive device includes a platen having a flat center surface surrounded by a border of textile engaging material mounted on the periphery of the platen. The border material has a structure that allows it to engage/grip the textile and hold it in place. One useful type of the textile holding material used in the invention is known as lint brush material.

The textile to be printed on is laid onto the platen surface and the edges are pulled taut to position and align the textile and remove wrinkles. The textile is next pressed/patted down onto the border material to be engaged by the border material. The border material grips and holds the textile in position, to thereby provide a smooth textile surface on which the ink jets are applied. After the printing operation, the textile is lifted off of the border material and removed from the platen.

The foregoing features and advantages of the present invention will be apparent from the following more particular description of the invention. The accompanying drawings, listed herein below, are useful in explaining the invention.

DRAWINGS

Figure 8:
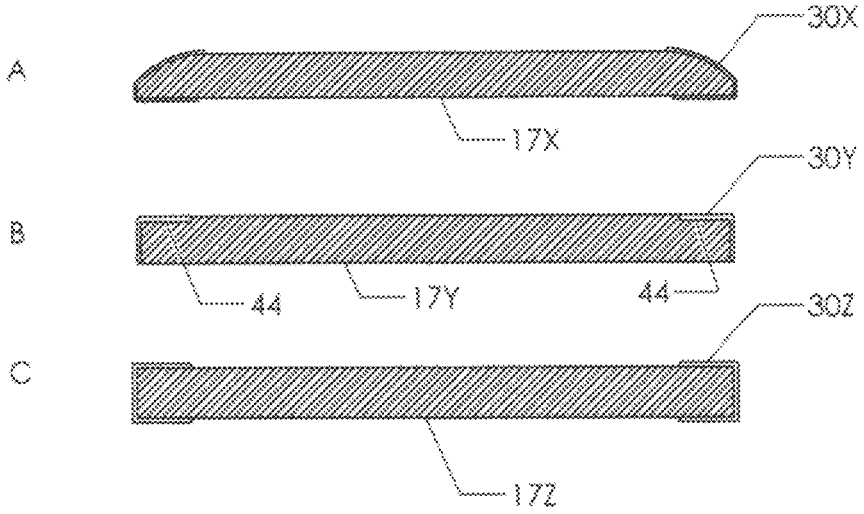
Figure 9:
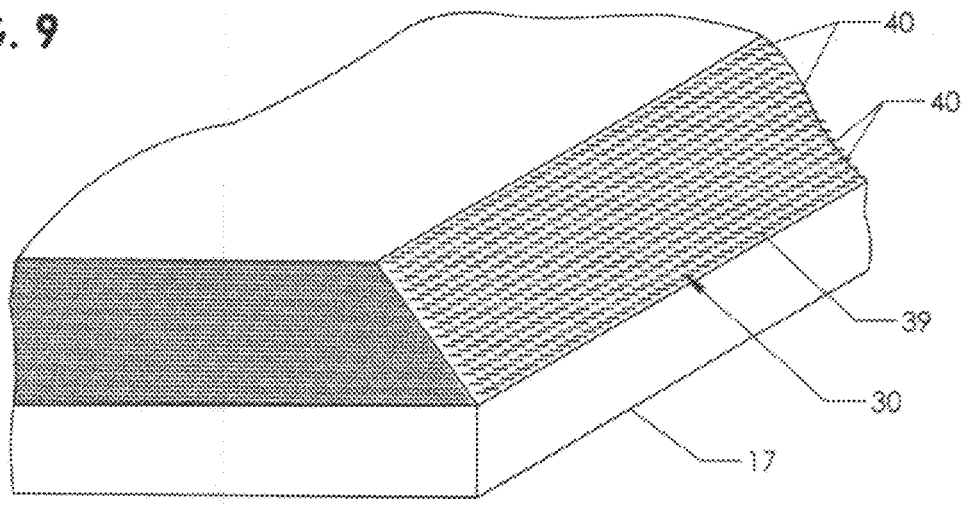

FIG. 8A-8C show details of various ways of positioning the border material on a platen wherein FIG. 8A shows beveled edges, FIG. 8B shows a platen with a square edge and the border material affixed to the top and side of the platen and FIG. 8C shows the border material wrapped completely around the edge of the platen; and, FIG. 9 is an enlarged view to show an embodiment of a preferred type of border material.

DESCRIPTION OF THE INVENTION

Figure 1:
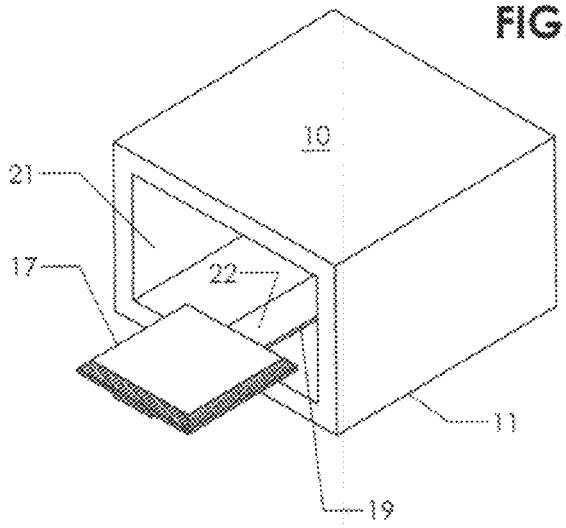
FIG. 1 depicts a textile digital printing machine of the type incorporating the present invention and the platen assembly on which the inventive device is positioned.

FIG. 1 depicts a digital printing machine 10 of well-known type wherein a textile 15 material (see FIG. 5) on which text, photos, caricatures, figures etc., is to be selectively printed. The printing machine 10 depicted in FIG. 1 is generally similar to the machine disclosed in the aforementioned U.S. Pat. No. 7,854,200. FIG. 1 depicts the housing 11 including a platen 17 on which the textile 15 (see FIG. 40) is to be positioned. Basically, the platen 17 is a cantilevered structure that extends over a support member. As shown in FIG. 1 platen 17 is commonly rectangular in shape may be mounted on an elongated flat plate/track 19. Platen 17 is slid/pushed into the housing 11 for the printing operation. For printing, the textile 15 is positioned to encase the platen 15 (see FIG. 5) with preferably only one layer of the textile lying flat over the platen and other textile layers being under the platen.

Figure 2:
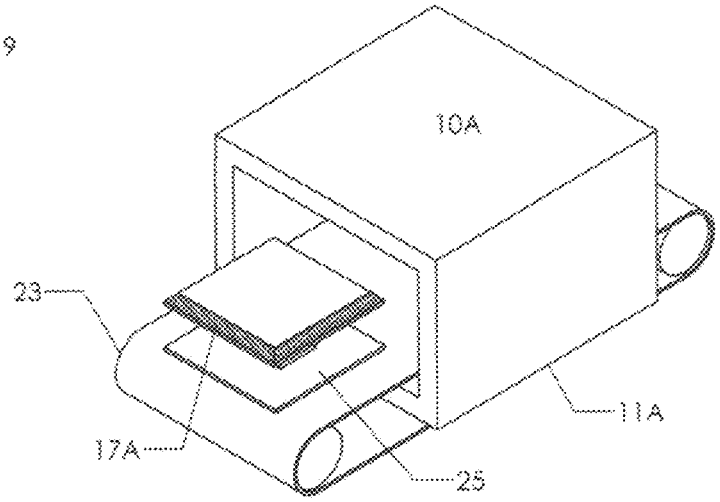
FIG. 2 is a view of second embodiment of a textile printing machine where an inventive platen assembly is utilized with a printing machine having a conveyor system for inserting and removing the platen (and the textile draped there over) from the printing machine.

FIG. 2 shows another embodiment of a printing machine 10A including a platen assembly 25. Printing machine 10A has a housing 11A in which a conveyor loop 23 of a suitable known design is mounted. Platen assembly 25 comprises a second embodiment of the platen labeled 17A; basically platen 17A is mounted on a support pedestal but otherwise is similar to platen 17. As depicted in FIG. 2, platen assembly is positioned on a conveyor 23 to be moved into the interior of housing 11A for printing the textile that is positioned on the platen assembly 25.

Figure 3:
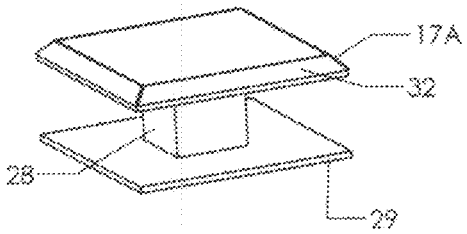
FIG. 3 is an isometric view of the platen assembly shown in FIG. 2.
Figure 4:
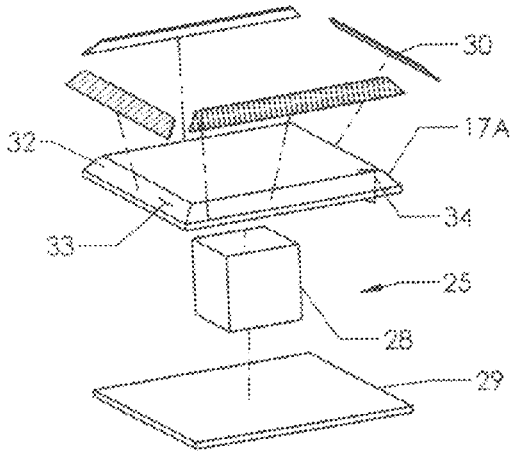
FIG. 4 is an exploded view of the platen assembly of FIG. 3 to more clearly show the structure of the platen assembly and the cantilever projections extending over the support.

Referring now also to FIGS. 3 and 4, platen 17A is mounted on a spacer block/cube 28, which in turn is mounted on a base plate 29 which together comprise the platen assembly 25. Platen 17A is cantilevered, that is, overhangs or extends beyond the block 28 on four sides. The inventive border material labeled generally as 30 is positioned on the sides generally labeled 32 of the platen 17A. As can be seen in FIG. 4, the sides 32 are beveled. The beveled surface provides a smooth curving surface for the textile 15 to rest on to thereby tend to maintain the textile on the surface of the platen 17A wrinkle free, taut and smooth.

In operation, the textile 15 to be printed is placed over platen 17A (and similarly on platen 17). The textile 15, for example a T-shirt (see FIG. 5), is inserted around the platen with one side of the T-shirt position on the top flat surface of the platen and the other side around the underside of the platen. The textile 15 is moved to a desired position on the platen and held in a flat unwrinkled condition by the border material 30, as will be explained. The platen assembly 25 is mounted on conveyor belt 23 of printing machine 10A and suitable known controls activate the conveyor to move the platen into the printing machine; or, in the embodiment of FIG. 1 the platen 17 and textile 15 are moved/slid into the printing machine 10 for the printing operation. After printing, the direction of motion of conveyor 23 is reversed and the platen is withdrawn to an initial position and the imprinted textile 15 is taken off of the platen 17A. In the embodiment of FIG. 17, the platen is pulled out of the machine 10 and the textile removed.

A very large percentage of the textile to be imprinted consists of the well known "T-shirts." It has been found that it is very convenient to use the disclosed cantilevered platens 17 and 17A where only one layer of a T-shirt is positioned to rest above the platen surface and the other layer of the shirt is underneath the platens. The cantilevered platen will be partially "wearing" the shirt, see FIG. 5. The present inventive border material functions best when only one layer of fabric is on the upper surface of the platen.

Figure 5:
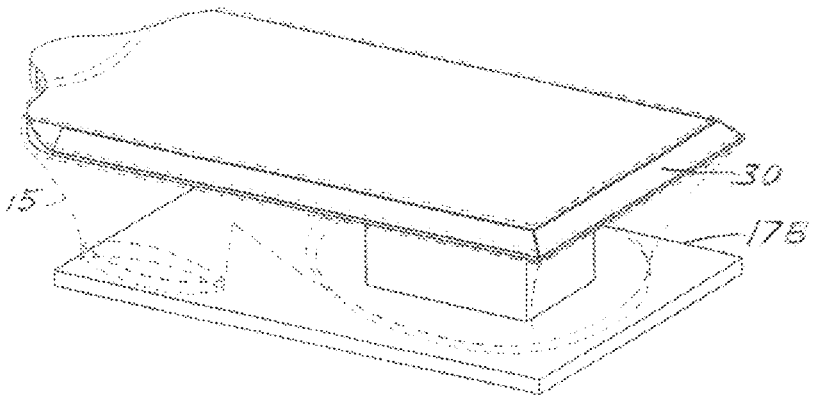
FIG. 5 is view of another embodiment of the platen assembly of FIG. 3 wherein a neck profile if formed on the platen plate and provides an effective feature particularly when printing T-shirts.

The exploded view of the platen 25 assembly clearly shows the positioning of the inventive border material 30 on the platen 17A. As can be seen in FIG. 3, the sides 32 of the platen 17A are beveled and the border material 30 comprising elongated panels or bands are cut/formed to fit or conform to the beveled sides 32. The border material is suitably attached by adhesive indicated at 33, or by suitable known clips indicated at 34. In the embodiments shown in FIGS. 3 and 4, the border material 30 extends completely around the sides of the platen 17A. In the embodiment of FIG. 5, the border material extends only on three sides, for reasons to be explained.

The width of the border material is selected dependent on the textile to be printed and the type of gripping material used, the selected gripping area, and gripping strength desired. It has been found that the wider the border the more grip strength provided, however this may result in less effective print area. In two present embodiments, border materials having widths of ⅜" and ¾" have been found effective, although these dimensions are limitations and other widths of border material can be used.

Figure 7:
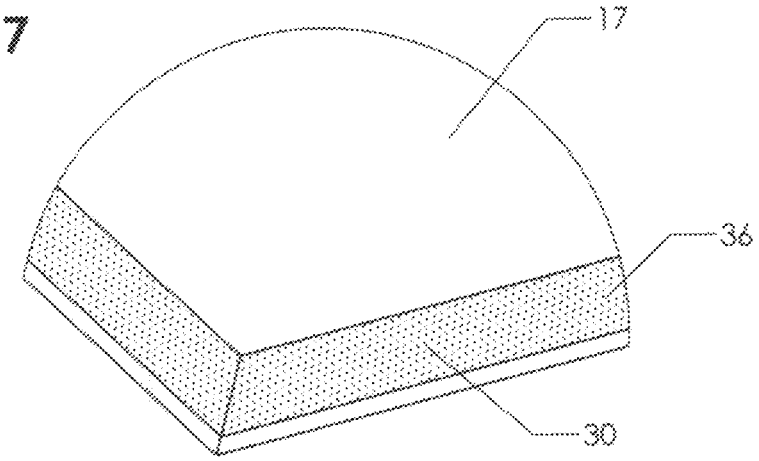
FIG. 7 is an isometric view to depict the gripping surface of one type of border material.

One type of border gripping material 30 is depicted in FIG. 7 indicating the material as having a coarse, knobbed or rough surface. The grip layer of border material 30 may also be a coarse, fibrous, foamed material or may be a processed hemp material. One excellent type of a border material 30 is known as "lint brush material." Lint brush material is textured and may include a warp weave, a knobbed or rough weave, to provide a non-smooth surface. Various types and brands of lint brush material are available commercially, one brand name being "Tricot."

Refer now to FIG. 9 which depicts a preferred embodiment of the lint brush border material 30 used in the present invention. As shown in the enlarged view of FIG. 9 the border material 30 is mounted on the sides of the platen 17 with the textured surface 39 of the lint brush material 30 facing outwardly. The textured surface 39 depicts flexible extensions or hairs 40 that extend outwardly from the surface and function to engage the textile material 15 when the textile material is pressed or pushed against the surface 39. That is, the extensions 40 tend to penetrate and sink into the textile, thus gripping and holding the textile in position. Extensions 40 may be made to extend in a single direction or in multiple direction to engage the textile dependent on type of textile which is to be processed. As mentioned above a large percentage of the textiles that are imprinted consist of "T-shirts," hence a border material such as depicted in FIG. 9 is well suited for used as the border material.

Figure 6:
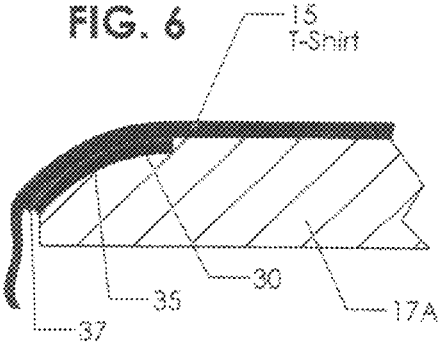
FIG. 6 is a relatively enlarged view in cross section to show the mounting of the border material positioned on the platen and more particularly show the groove or recess formed on the edges of the platen.

FIG. 6 is a view to show the border material 30 positioned on the beveled and grooved side 32 of the platen 17A. As shown, the border material 30 includes a base layer 35 of any suitable flexible material and a layer of textile gripping material 37. The base layer 35 is affixed to platen 17A by adhesive. The groove/recess 41 on side 32 of platen functions to retain the base layer 35 of border material 30 more securely in place. In addition to providing a securing place for the border material the groove 41 also assures that the top surface of platen 17A plus the thickness of the border material 30 present a smooth level printing surface for the textile 15.

FIG. 4 discloses another embodiment of the platen labeled 17B. One side (the top side) of platen 17B is contoured to form a neck profile 35 for accommodating placement of textiles and particularly the important T-shirts products on the platen. As mentioned above, T-shirts are the garments on which the printing, text, pictures and characters etc., are most frequently applied. As depicted in FIG. 5, in this embodiment of the platen 15B the one side, the neck profile 35 conveniently provides a means of quickly and more properly positioning the T-shirt on the platen 17B for the printing process. In the embodiment of FIG. 4, border material 30 is not placed on one side of the plated 17B to conveniently permit the T-shirt to be placed (slipped onto) the platen via the neck profile, arranged, positioned with any engagement gripping by the border material. The T-shirt is then affixed to the border material 30 on the other three sides of the platen. Likewise, for other applications the border material can be placed on only three or possibly even two sides of the platen dependent on the garment 15 being printed.

FIGS. 8A-8C show other ways of mounting the border material 30 on to the platens 17, 17A, 17B. In operation the textile 15 is caused to engage to the border material 15, and hence when the textile is pulled and stretched to flatten and fit onto the platen, a pulling force will be exerted on the border material. The border material must thus be properly affixed to the pattern. As described with reference to the sides 32 of the platen 17 are recessed to receive the border material which provides a level platen printing surface and also assists in holding the border material in place.

FIG. 8A shows a different way for affixing the border material 30X to a platen 17X having a beveled edge and wherein the border material 30X is wrapped around the entire edge of a platen 17X and adhered by adhesive. In this modification, the border material is of a lesser thickness and slight variation of the border material above the printing plane is acceptable for certain printing operations.

FIG. 8B shows a platen 30Y having a square edge and border material wrapped around the upper and outside edges. FIG. 8 shows that the edges of the platen have been recessed to compensate for the thickness of the border material 30Y, to thereby maintain a smooth planar surface on the platen 17A, similarly as described for FIG. 6. In one embodiment, the lint brush material used is an unidirectional hair fabric adhered to ⅛" thick open cell foam, and the overall thickness is about 3⁄16". Accordingly, the platen top was machined as at 44 to provide for a recessed area around the sides of the platen as to maintain the border grip material 30Y level with the printing plane.

FIG. 8C shows a platen 17Z having the border material 30Z wrapped around the upper, lower and side edges of the platen 17Z. Similarly as in FIG. 8A, the border material is of a lesser thickness and a slight variation of the border material above the printing plane is acceptable for certain printing operations.

Other such positioning of the border material 30 onto a platen 17 can of course be envisioned. The desired result is that the border material be firmly affixed to the platen to hold the textile 15 flat, wrinkle free, and taut on the planar face of the platens.

A significant advantage and feature of the present invention, and in particular with the neck profile embodiment of the platen shown in FIG. 5 is that loading/mounting of T-shirts and most other garments will be quicker/faster with the border grip material than with previously known platens. The border material will catch a T-shirt or other textile at the edge of the platen yet allow the interior portion of the fabric to flatten freely. The full operation is relatively much faster since the operator has to only position and press/pat the garment onto the border material to prepare for the printing cycle.

While the invention has been particularly shown and described with reference to preferred embodiments thereof, it will be understood by those skilled in the art that various changes in form and details may be made therein without departing from the spirit and scope of the invention.

The invention claimed is:

1. A device for holding down textile material on a platen of a digital printing machine, the device comprising:

a platen having a flat planar surface, said platen having downwardly extending sides and edges;

a flexible gripping material comprising a unidirectional lint brush cloth forming a textile gripping area, the gripping material being selectively positionable on the border of said platen planar surface;

wherein said textile may be placed on said platen planar surface and located and positioned to be engaged by said flexible gripping material to hold said textile in position over said planar surface for printing thereon.

2. A device as in claim 1 wherein said gripping material includes a surface having elongated extensions formed thereon that comprise miniature lines to catch and selectively grasp said textile and hold said textile.

3. A device as in claim 1 wherein the edges of said platen are beveled and said flexible gripping material is mounted on said beveled surface to extend downwardly from said planar surface.

4. A device as in claim 1 wherein said flexible gripping material is mounted to be in parallel to the plane of said planar surface.

5. A device as in claim 1 wherein said flexible gripping material is mounted to wrap around the edges of said platen.

6. A device for holding down a T-shirt on a platen of a digital printing machine for printing on said T-shirt, the device comprising:

a platen having a planar printing surface, said platen being rectangular in shape with three substantially straight sides and one side formed to have a neck profile;

a flexible textile gripping material of a unidirectional lint brush cloth, said gripping material being selectively positionable on at least two of said straight sides of said platen to selectively engage said T-shirt in a smooth taut condition;

said neck profile being free of said gripping material, said neck profile enabling said T-shirt to be smoothly slipped around and encircle said neck profile and a major portion of said platen and to have on layer or side of said T-shirt positioned and held for printing on said printing surface.

7. A device for holding down textile material on a platen of a digital printing machine, the device comprising:

a platen having a flat planar surface;

a flexible textile gripping material of lint brush cloth, having elongated extending fibers to grip the textile material, said gripping material selectively positionable on the border of said flat planar surface; and wherein said textile material may be placed on said platen flat planar surface and located and positioned to be engaged by said gripping material to hold said textile in position over said flat planar surface for subsequent printing on the textile material.

8. A device as in claim 7 wherein said fibers have a multi direction orientation.

9. A device as in claim 7 wherein said gripping material is selectively positioned on said flat planar surface to enable printing on the textile material.

10. A device as in claim 1 wherein said gripping fibers are mounted to extend in a direction away from the center of said platen.

* * * * *